US011545082B1

(12) United States Patent
L'Episcopo et al.

(10) Patent No.: US 11,545,082 B1
(45) Date of Patent: Jan. 3, 2023

(54) METHOD FOR HYBRID PULSE AMPLITUDE AND WIDTH MODULATION IN LED DRIVERS FOR DISPLAY PANELS

(71) Applicant: STMicroelectronics S.r.l., Agrate Brianza (IT)

(72) Inventors: Gaetano L'Episcopo, Catania (IT); Giovanni Conti, Catania (IT); Mario Antonio Aleo, Catania (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 17/726,909

(22) Filed: Apr. 22, 2022

(51) Int. Cl.

| | |
|---|---|
| ***G09G 3/32*** | (2016.01) |
| ***G09G 3/34*** | (2006.01) |
| ***G09G 3/20*** | (2006.01) |
| ***G09G 3/3225*** | (2016.01) |
| ***G09G 5/10*** | (2006.01) |

(52) U.S. Cl.
CPC ..... *G09G 3/32* (2013.01); *G09G 3/2022* (2013.01); *G09G 3/2081* (2013.01); *G09G 3/3225* (2013.01); *G09G 3/3426* (2013.01); *G09G 5/10* (2013.01); *G09G 2320/0247* (2013.01); *G09G 2320/064* (2013.01); *G09G 2320/0633* (2013.01)

(58) Field of Classification Search
CPC ..... G09G 3/2022; G09G 3/2081; G09G 3/32–3291; G09G 3/3406–3426; G09G 5/10; G09G 2320/0247; G09G 2320/0633; G09G 2320/064
See application file for complete search history.

(56) References Cited

U.S. PATENT DOCUMENTS

| | | | | |
|---|---|---|---|---|
| 8,840,255 | B2 * | 9/2014 | Jackson | G09G 3/2014 372/29.016 |
| 10,671,826 | B2 * | 6/2020 | Torello | H04L 67/12 |
| 10,880,687 | B2 * | 12/2020 | Torello | H02J 13/00028 |
| 11,145,260 | B2 * | 10/2021 | Calayir | G09G 3/3611 |
| 11,343,890 | B2 * | 5/2022 | Lopez Julia | H05B 45/37 |
| 11,398,180 | B2 * | 7/2022 | Li | G09G 3/2022 |
| 2010/0188443 | A1 * | 7/2010 | Lewis | G09G 3/3413 345/691 |
| 2015/0116379 | A1 * | 4/2015 | Lim | G09G 3/342 345/691 |
| 2022/0085127 | A1 * | 3/2022 | Xuan | G09G 3/2014 |

* cited by examiner

*Primary Examiner* — Gene W Lee
(74) *Attorney, Agent, or Firm* — Crowe & Dunlevy

(57) ABSTRACT

A method includes determining a number of drive pulses of equal width and amplitude that would drive LEDs with a total charge during a frame. If the width of the drive pulses is greater than a minimum-width and less than a maximum-width, the LEDs are driven with the drive pulses. If the width of the drive pulses is less than the minimum-width and an amplitude of the drive pulses is greater than a minimum-amplitude, decrement the amplitude of the drive pulses and recalculate the width of the drive pulses so each drive pulse has the decremented amplitude and recalculated width. If the amplitude of the drive pulses is equal to the minimum-amplitude, reduce the number of drive pulses and recalculate the width and amplitude of the reduced number of drive pulses. If the amplitude of the drive pulses is equal to the minimum-amplitude, the LEDs are not driven.

18 Claims, 7 Drawing Sheets

METHOD FOR HYBRID PULSE AMPLITUDE AND WIDTH MODULATION IN LED DRIVERS FOR DISPLAY PANELS

TECHNICAL FIELD

This disclosure is related to the field of display technology and, in particular, to hardware and techniques for driving light emitting diodes (LEDs) within passive or active displays to enable enhanced brightness control without visible flicker to the human eye.

BACKGROUND

Many electronic devices, such as smartphones, smartglasses, smartwatches, tablets, laptops, monitors, and televisions utilize display panels for the purposes of displaying information to users. Such display panels are organized into a two-dimensional matrix of rows and columns, with the intersections between rows and columns representing display elements such as zones (in the case of non-emissive displays) and pixels (in the case of emissive displays).

A sample type of non-emissive display is a liquid crystal display (LCD), commonly used in televisions for example, and a sample type of emissive display is an organic light emitting diode (OLED) display, commonly used in smartphones for example.

A sample LCD based non-emissive display panel 12 incorporated into a free-standing display 10 is shown in FIG. 1A. The non-emissive display panel 12 is formed by a two-dimensional matrix of display zones, with a sample display zone being indicated by reference numeral 15. Each display zone 15 contains multiple pixels, with each pixel containing at least one red sub-pixel, at least one green sub-pixel, and at least one blue sub-pixel.

The illustrated display zone 15 is representative of each of the display zones within the non-emissive display panel 12 and includes a liquid crystal LC 16*a* for modulating display of the color red, a liquid crystal LC 16*b* for modulating display of the color green, and a liquid crystal LC 16*c* for modulating display of the color blue. The liquid crystals 16*a*-16*c* are arranged over a backlight for that zone, which here is formed by one or more light emitting diodes (LEDs) 17.

Additionally or alternatively, the liquid crystals 16*a*, 16B, and 16*c* may modulate the display of colors other than red, green, and blue. Also, the LEDs 16*a*-16*c* may be connected in series and/or parallel.

The specific layer structure forming the non-emissive display panel 12 can be seen in FIG. 1B, where it can be observed that a backlight backpane 13 carries backlight LEDs 17, with a color conversion and diffusion layer 19 being disposed over the backlight LEDs 17. The backlight LEDs 17 may be so-called "mini" or "micro" LEDs. The liquid crystals 16 are disposed over the color conversion and diffusion layer 19 (or multiple color conversion and diffusion layers), and a display glass layer 18 is disposed over the liquid crystals 16. The backlight backpane 13 and LEDs 17 can be collectively referred to as a matrix 14.

Images are produced by the LEDs 17 emitting light which is then converted by the color conversion and diffusion layer 19 into different beams of red, green, and blue light (or, for example, beams of light in colors other than red, green, and blue) which in turn pass through the liquid crystals 16 and out of the display glass 18. A voltage across each individual liquid crystal 16 is modulated, causing those individual liquid crystals to change in transparency, thereby modulating the amount of light passing through those liquid crystals. Different colors are displayed by operation of the liquid crystals 16 modulating the intensity of the red, green, and blue light beams (or other colored light beams, as described above) as they pass therethrough. Since the source of the light itself is the LEDs 17 with a given zone, and not the pixels within that given zone, the display panel 12 is considered to be non-emissive (e.g., have non-emissive pixels located within emissive zones, with each zone providing light to multiple pixels).

In operation, each zone is addressed by the simultaneous activity of a corresponding row driver and column driver for that zone, resulting in current flow through the LEDs of the zone. This current flow may be in the form of pulses, modulated by their amplitude or width so as to achieve a desired brightness. Activation is divided into different frames, with row activation being multiplexed over each frame, with one or more rows being activated at the same time, and column activation being synchronized with row activation; alternatively, column activation may be multiplexed over each frame, with one or more columns being activated at the same time, and row activation may be multiplexed over each time frame.

A sample emissive display panel 22 incorporated into a free-standing display 20 is shown in FIG. 2A. The emissive display panel 22 is formed by a two-dimensional matrix of pixels, with a sample pixel being indicated by reference numeral 25. Each pixel, such as pixel 25, contains at least one red sub-pixel, at least one green sub-pixel, and at least one blue sub-pixel. For example, pixel 25 includes a sub-pixel having a light emitting diode (LED) 26*a* that generates blue light, a sub-pixel having an LED 26*b* that generates green light, and a sub-pixel having an LED 26*c* that generates red light. The LEDs 26*a*-26*c* may be organic light emitting diodes (OLEDs) or micro-LEDs, for example. Each pixel 25 may additionally or alternatively include one or more sub-pixels with LEDs that emit light having a color other than red, green, or blue.

The specific layer structure forming the emissive display panel 22 can be seen in FIG. 2B, where it can be observed that a panel backpane 23 carries the LEDs 26, with a display glass 28 disposed over the LEDs 26. One or more color conversion layers can be interposed between the panel backpane 23 and the display glass. The panel backpane 23 and LEDs 26 can collectively be referred to as matrix 24.

Images are produced by the LEDs 16 emitting light of different intensities. Each pixel contains at least one red LED 26*c*, at least one green LED 26*b*, and at least one blue LED 26*a*. Each pixel can display a desired color by modulation of the intensity of the light produced by its LEDs 26. Since the source of the light itself is the LEDs 26, which are also the source of the colors produced by a given pixel, the display panel 22 is considered to be emissive (e.g., have emissive pixels, with each pixel providing its own light).

In operation, each pixel is addressed by the simultaneous activity of corresponding row drivers and column drivers for the sub-pixels of that pixel, resulting in current flow through the LEDs of the pixel. This current flow may be in the form of pulses, modulated by their amplitude or width so as to achieve display of the desired color at a desired brightness. Activation is divided into different frames, with row activation being multiplexed over each frame, with one or more rows being activated at the same time, and column activation being synchronized with row activation; alternatively, column activation may be multiplexed over each frame, with one or more columns being activated at the same time, and row activation may be multiplexed over each time frame.

As explained above, pulse width and amplitude modulation are performed on the currents to the LEDs in both non-emissive and emissive displays in order to achieve brightness control. The amount of illumination of each display LED is proportional to the area of the train of current pulses provided to the LED (i.e., the charge transferred to the LED)—the larger the area of the pulses, the higher the illumination of the LEDs.

An issue arises because under certain circumstances, the human eye can detect the on-off flickering of display LEDs. For example, if the frequency of the driving of the LEDs is below a certain threshold (e.g., 600 Hz), if the brightness of the LEDs is changed significantly over a small interval of time, if the pulse width modulation of the LED currents results in a particular small pulse width, or if pulses are skipped, flicker may be perceived by the human eye. The perception of flicker may result in discomfort to the viewer including eye strain, headache, or nausea, and may result in the viewers seeing artefacts in the displayed images.

This is clearly undesirable, and therefore attempts at mitigating flicker have been developed. Existing attempts, however, may still result in visible flicker in certain scenarios. As such, further development is needed.

SUMMARY

Disclosed herein is a method of driving a light emitting diode (LED) array, including receiving image data for a new image frame, and determining a total aggregate charge to be transferred to LEDs of the LED array during the image frame. The method also includes determining a number of drive pulses of equal width and equal amplitude that would drive the LEDs with the total aggregate charge during display of the image frame. If it is not possible given operating conditions for each pulse to have an equal width and an equal amplitude while driving the LEDs with the total aggregate charge during the display of the image frame, the method includes determining a number of drive pulses of equal width and equal amplitude that would drive the LEDs with nearly the total aggregate charge during the display of the image frame and modifying at least one of the number of drive pulses based upon residual charge to be transferred during the display of the image frame such that the number of drive pulses can drive the LEDs with the total aggregate charge during the display of the image frame.

If the width of the number of drive pulses is greater than a minimum width and less than a maximum width, the method includes driving the LEDs with the number of drive pulses.

If the width of the number of drive pulses is less than the minimum width, and if an amplitude of the number of drive pulses is greater than a minimum amplitude, the method includes decrementing the amplitude of the number of drive pulses and recalculating the width of the number of drive pulses such that each drive pulse has the decremented amplitude and the recalculated width.

If the width of the number of drive pulses is less than the minimum width, if the amplitude of the number of drive pulses is equal to the minimum amplitude, and if the number of drive pulses is greater than one, the method includes decrementing the number of the drive pulses and recalculating the decremented number of the drive pulses as having an equal width and equal amplitude that would drive the LEDs with the total aggregate charge during display of the image frame.

If the width of the number of drive pulses is less than the minimum width, if the amplitude of the number of drive pulses is equal to the minimum amplitude, and if the number of drive pulses is equal to one, the method includes not driving the LEDs with the number of drive pulses and then moving to a new image frame.

Determining the number of drive pulses of equal width and equal amplitude may include setting the amplitude of the number of drive pulses to be equal to a fixed starting amplitude, and then determining the width of the number of drive pulses based upon the amplitude, the total aggregate charge, the number of drive pulses, a rise time of the number of drive pulses, and a fall time of the number of drive pulses. Determining the number of drive pulses of equal width and equal amplitude may also include determining the residual charge to be transferred, and if the residual charge is not within a threshold of zero, modifying the width of at least one of the number of drive pulses based upon the residual charge and the fixed starting amplitude.

Determining the number of drive pulses of equal width and equal amplitude may include setting the width of the number of drive pulses to be equal to a fixed starting width, and then determining the amplitude of the number of drive pulses based upon the width, the total aggregate charge, the number of drive pulses, a rise time of the number of drive pulses, and a fall time of the number of drive pulses. Determining the number of drive pulses of equal width and equal amplitude may also include determining the residual charge to be transferred, and if the residual charge is not within a threshold of zero, modifying the amplitude of at least one of the number of drive pulses based upon the residual charge and the fixed starting width.

If the width of the number of drive pulses is greater than or equal to the minimum width and the width of the number of drive pulses is greater than the maximum width, the method may also include if the amplitude of the number of drive pulses is less than a maximum amplitude, incrementing the amplitude of the number of drive pulses and recalculating the width of the number of drive pulses such that each drive pulse has the incremented amplitude and the recalculated width. If the amplitude of the number of drive pulses is less than a maximum amplitude and the number of drive pulses is equal to an initial number of drive pulses, the method may include setting the width of the number of drive pulses to the maximum width and driving the LEDs with the number of drive pulses. If the amplitude of the number of drive pulses is less than a maximum amplitude and the number of drive pulses is less than the initial number of drive pulses, the method may include incrementing the number of the drive pulses and recalculating the incremented number of the drive pulses as having an equal width and equal amplitude that would drive the LEDs with the total aggregate charge during display of the image frame.

DETAILED DESCRIPTION

The following disclosure enables a person skilled in the art to make and use the subject matter disclosed herein. The general principles described herein may be applied to embodiments and applications other than those detailed above without departing from the spirit and scope of this disclosure. This disclosure is not intended to be limited to the embodiments shown but is to be accorded the widest scope consistent with the principles and features disclosed or suggested herein. Do note that in the below description, any described resistor or resistance is a discrete device unless the contrary is stated and is not simply an electrical lead between two points. Thus, any described resistor or resistance coupled between two points has a greater resistance than a lead between those two points would have, and such resistor or resistance cannot be interpreted to be a lead. Similarly, any described capacitor or capacitance is a discrete device unless the contrary is stated and is not a parasitic unless the contrary is stated. Moreover, any described inductor or inductance is a discrete device unless the contrary is stated and is not a parasitic unless the contrary is stated.

Figure 1A:
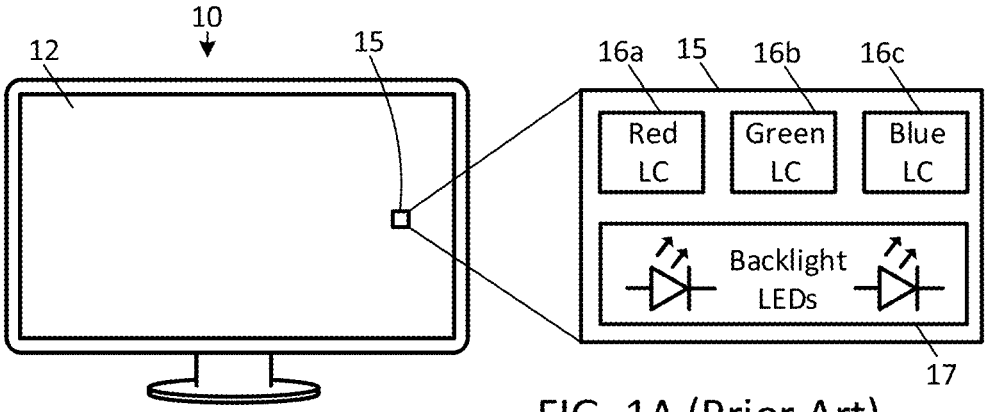
FIG. 1A (Prior Art)
FIG. 1A is a diagrammatical representation of a known non-emissive display.
Figure 1B:
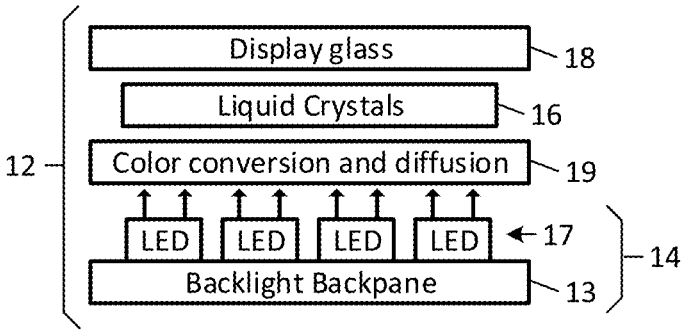
FIG. 1B (Prior Art)
FIG. 1B is a diagrammatical representation of cross section of the non-emissive display of FIG. 1A.
Figure 2A:
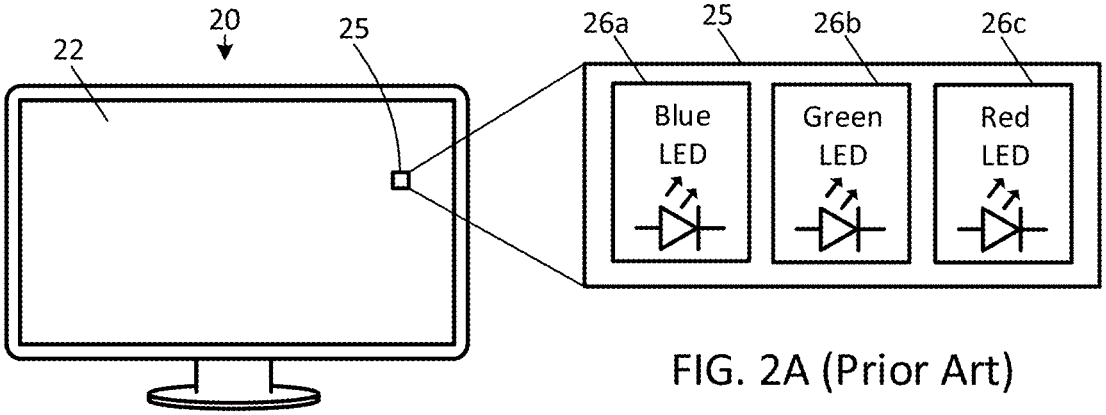
FIG. 2A (Prior Art)
FIG. 2A is a diagrammatical representation of a known emissive display.
Figure 2B:
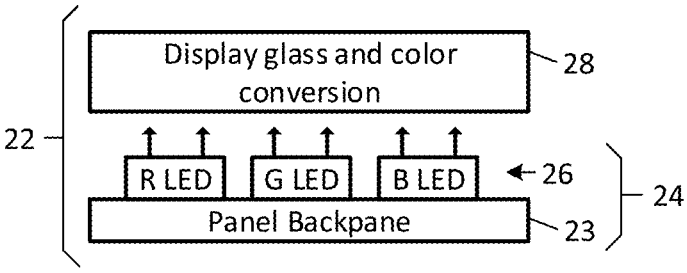
FIG. 2B (Prior Art)
FIG. 2B is a diagrammatical representation of cross section of the emissive display of FIG. 2A.
Figure 3:
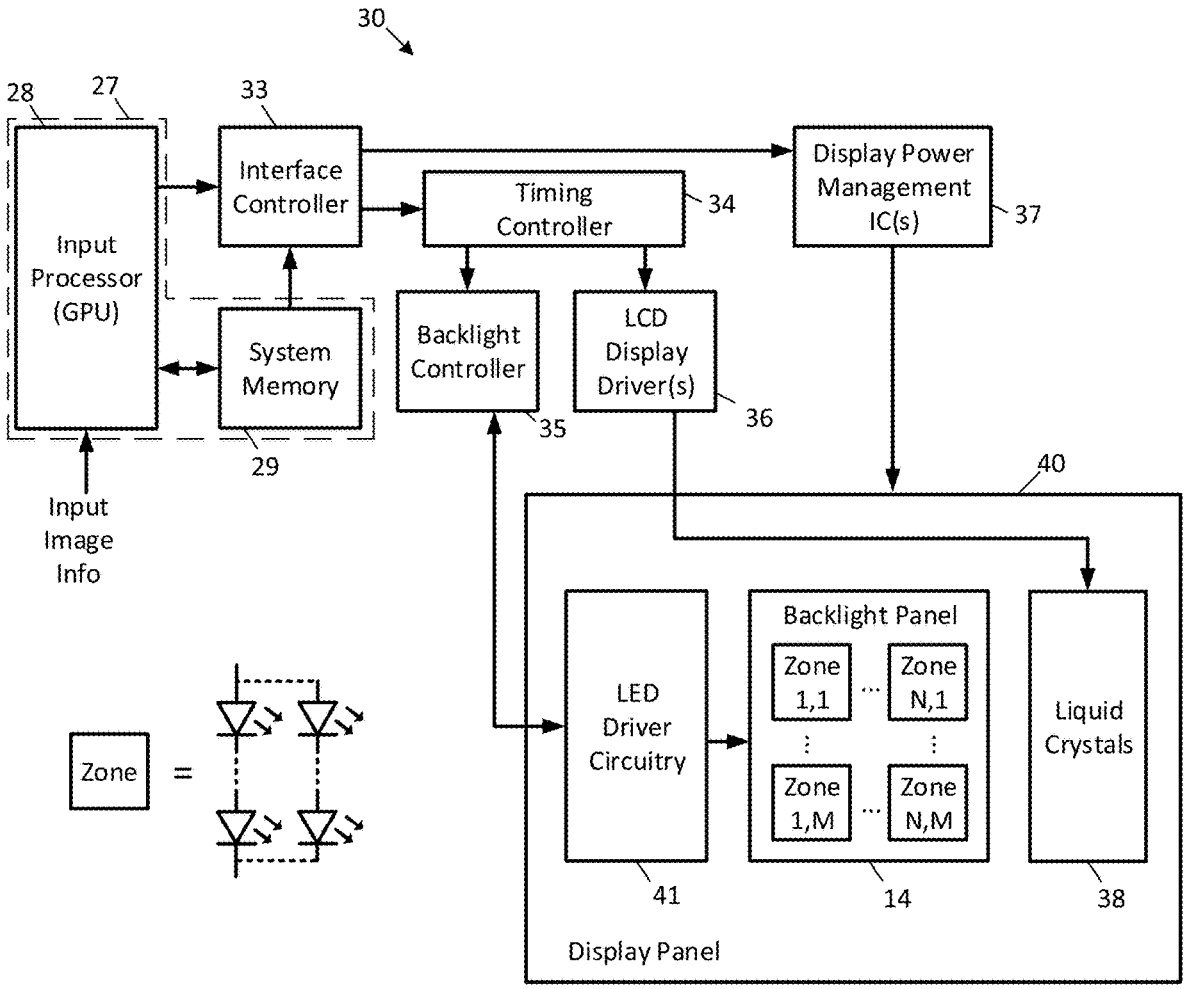
FIG. 3 is a block diagram of a display matrix of the non-emissive display of FIGS. 1A and 1B, which is controlled to perform the dimming technique described herein.

A design for a display 30 utilizing a non-emissive display panel 40 is now described with reference to FIG. 3. The display 30 includes an interface controller 33 that receives input from an external device 27, such as a system-on-a-chip (SOC) or microcontroller including an input processor 28 (such as a GPU) and a system memory 29 in bidirectional communication with the input processor 28. The input processor 28 receives input image information and cooperates with the system memory 29 to generate an output to the interface controller 33 indicating the next frame of image data to be displayed on the liquid crystal layer 38 of the display panel 40. The interface controller 33 processes the output from the input processor 28, and provides outputs to a timing controller 34 and display power management circuitry 37. The timing controller 34 coordinates with the backlight controller 35 to provide control signals to the drivers 41 (e.g., respective row and column drivers) associated with the backlight panel 14, and the LCD display drivers 36 to provide control signals to the liquid crystals 38, to enable coordination between the backlight panel 14 and the liquid crystals 38 so as to achieve image display. Each of the illustrated zones within the backlight panel 14 may include multiple serially connected LEDs, and those LED strings may be connected in parallel with one another.

The operation of the driver circuitry 41 to accomplish brightness control (i.e., dimming) without visible flicker will be described below, but first, since such details are equally applicable to a display utilizing an emissive display panel, a display utilizing an emissive display panel will first be described.

Figure 4:
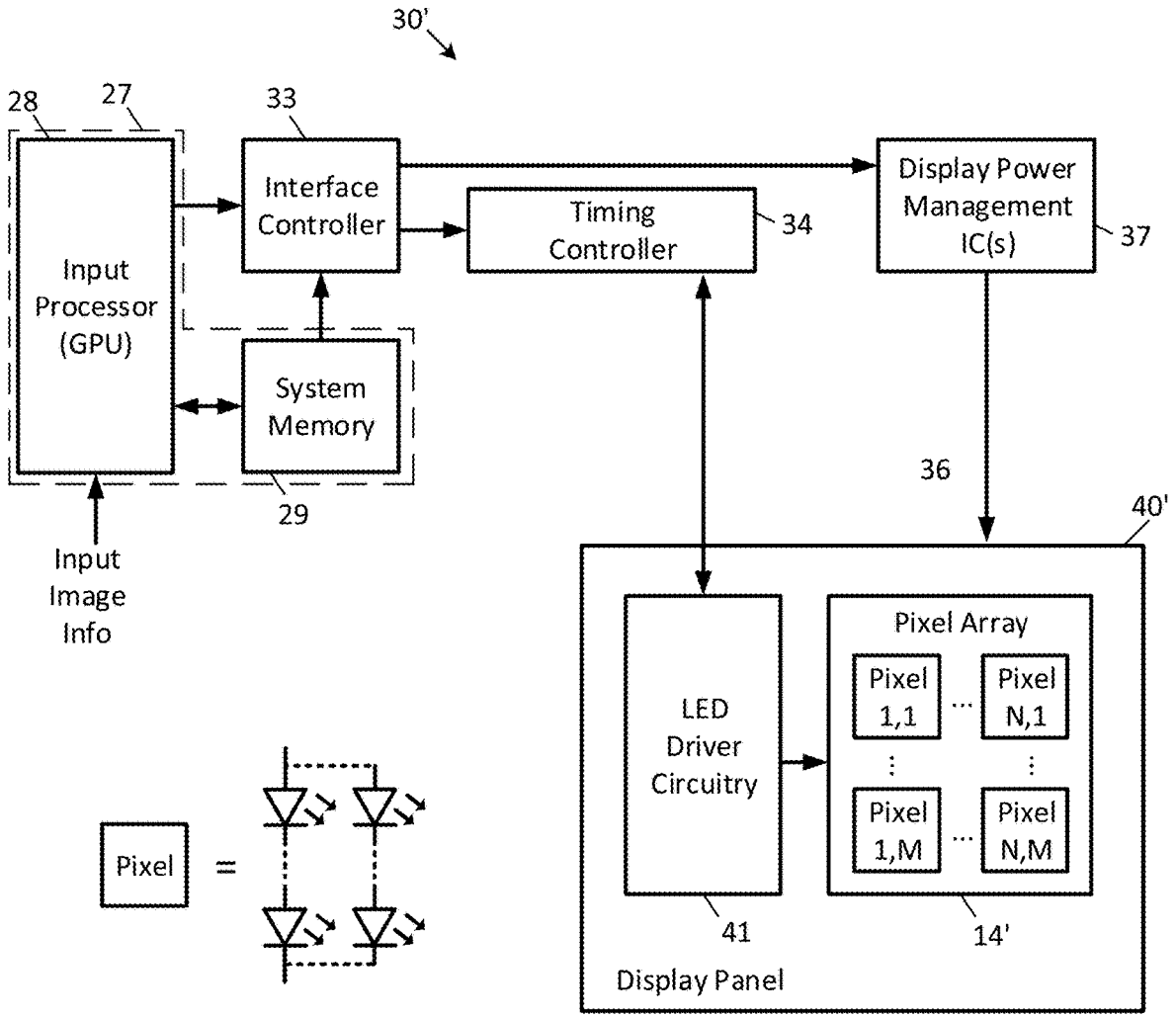
FIG. 4 is a block diagram of a display matrix of the emissive display of FIGS. 2A and 2B, which is controlled to perform the dimming technique described herein.

A design for a display 30' utilizing an emissive display panel 40' is now described with reference to FIG. 4. The display 30' includes an interface controller 33 that receives input from an external device 27, such as a system-on-a-chip (SOC) or microcontroller including an input processor 28 (such as a GPU) and a system memory 29 in bidirectional communication with the input processor. The input processor 28 receives input image information and cooperates with the system memory 29 to generate an output to the interface controller 33 indicating the next frame of image data to be displayed on the display matrix 14'. The display matrix 14' is emissive and may generate colored RGB light from the sub-pixels of each pixel, and additionally or alternatively may generate different light colors other than RGB from the sub-pixels of each pixels. The interface controller 33 processes the output from the input processor 28 and provides outputs to a timing controller 34 and display power management circuitry 37. The timing controller 34 provides control signals to the drivers 41 associated with the display panel 14' to provide control signals so as to achieve image display.

Each of the illustrated pixels within the display matrix 14' includes sub-pixels of different colors (for example, red, green, blue, and/or other colors), and each such sub-pixel may include multiple serially connected LEDs of the appropriate color, and those multiple LED strings may be connected in parallel with one another.

The operation of the driver circuitry 41 to accomplish brightness control (i.e., dimming) without visible flicker will now be described, but first, certain terms that will be used in the description of that operation will be explained in detail.

As explained above, the amount of illumination provided by each display LED is proportional to the area of the train of current pulses provided to that LED (i.e., the amount of illumination provided by each display LED is proportional to the charge Q transferred to that LED). Refer to an example pulse train of k pulses shown in FIG. 5. The pulse train of k pulses is within a single image frame period, and the charge Q is divided between the k pulses of the frame. Each pulse 50 has an amplitude A, a pulse width W, a rise time $t_{rise}$, and a fall time $t_{fall}$.

Although the pulse train shown has pulses with the rising and falling edges the same shape and width, other pulse trains may be used. For example, the shape of the rising and falling edges may be different than that illustrated (e.g., ramp shaped, quadratic shaped, S-shaped, etc.), and the shapes (and widths) of the rising and falling edges may be different from one another.

Figure 6A:
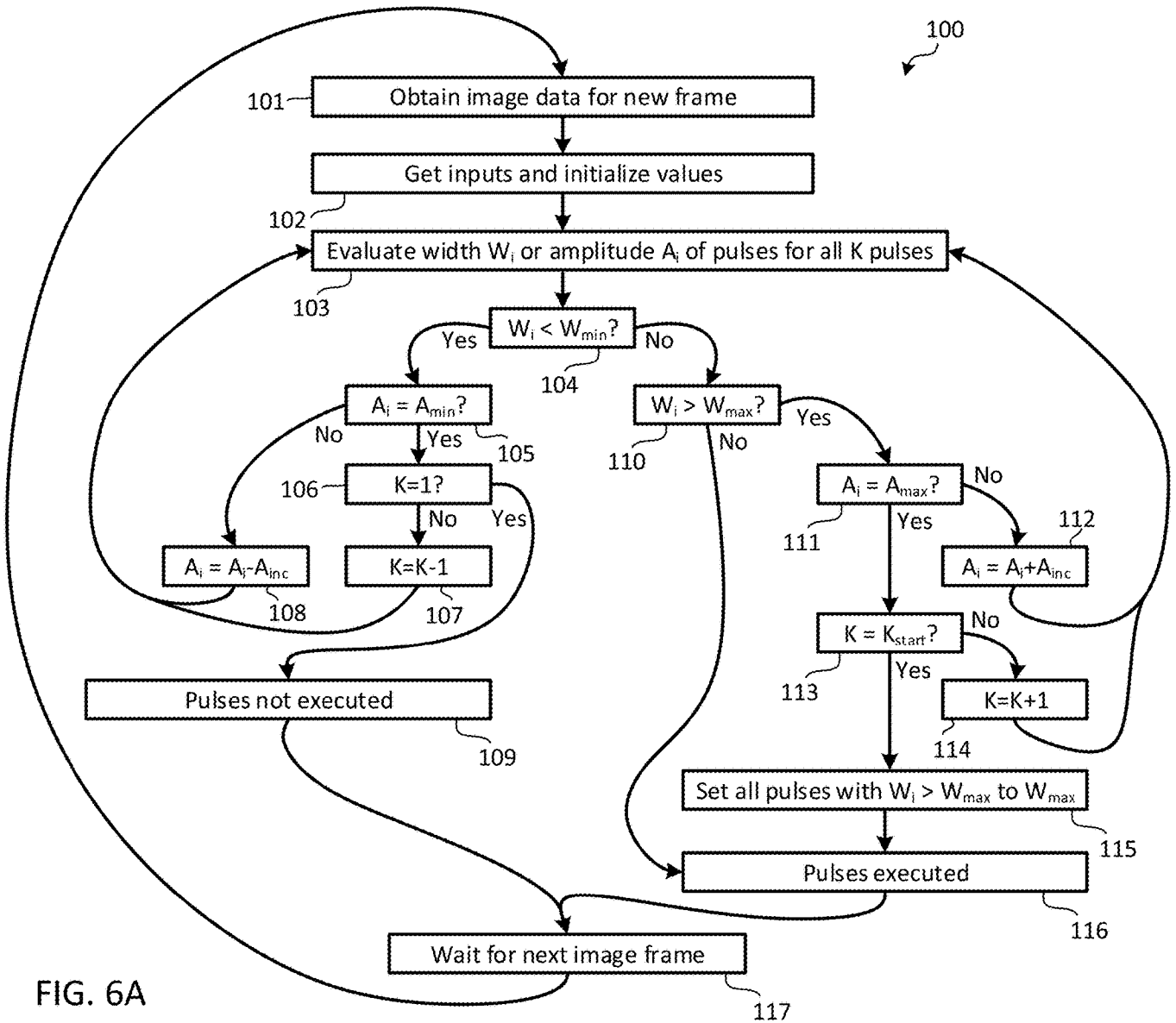
FIG. 6A is a flowchart showing the dimming technique described herein that enables brightness control of LEDs in a display panel while avoiding visible flicker.

Referring now to the flowchart 100 of FIG. 6A, the operation of the timing controller 34, backlight controller 35 (if a non-emissive display is used), and driver circuitry 41 (which generates the current pulses that drive the pixel array 14') for brightness control without visible flicker is described.

Figure 5:
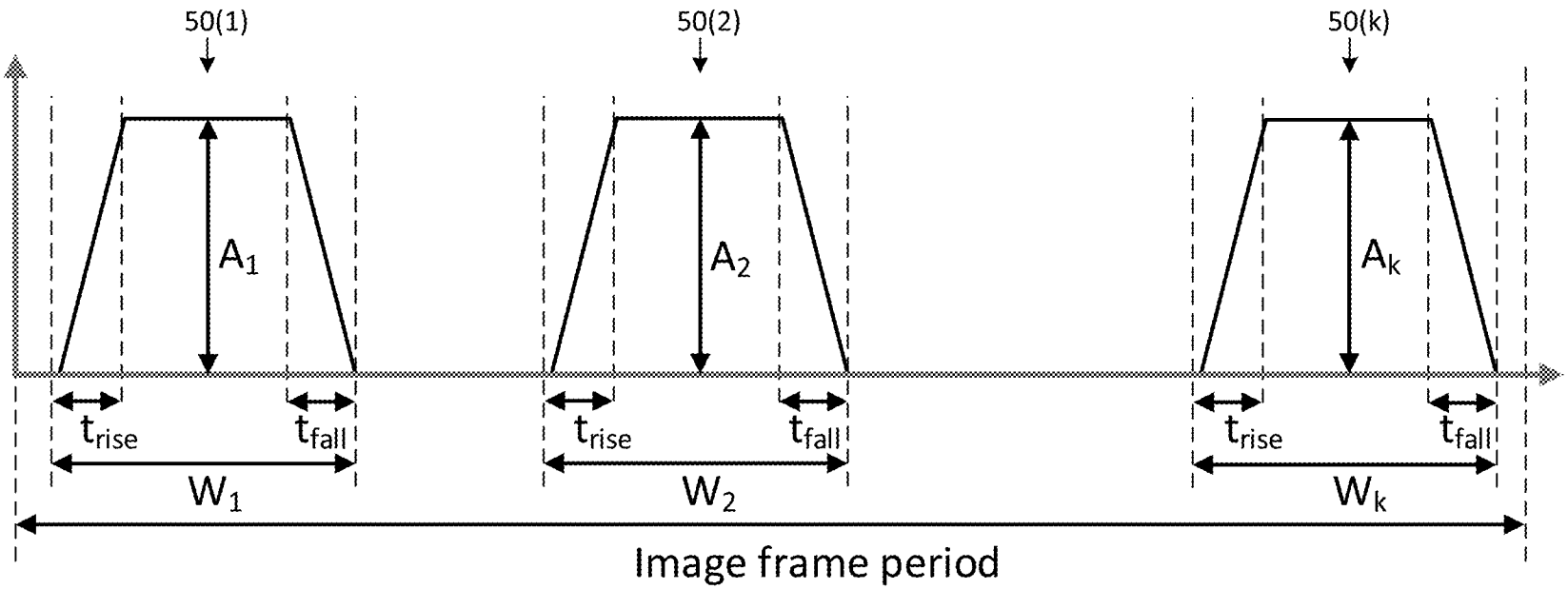
FIG. 5 is a graph showing an example of a train of pulses used to drive the LEDs of FIG. 3 or 4 when performing the dimming technique described herein.

Note that in the following descriptions, all formula used (and formulae derived therefrom) are suited for the example pulse train shape shown in FIG. 5, but if the pulse shape changes, these formula may appropriately change, without impacting the applicability of this disclosure to numerous applications.

In the steps described below, the stated actions are performed by the timing controller 34 and/or the backlight controller 35 and/or the LED driver circuitry 41. Operation proceeds on a frame-by-frame basis. Therefore, at the beginning of each frame, image data for that frame is obtained (Block 101). This image data includes brightness data, and from this the timing controller 34 and/or backlight controller 35 determines or is aware of the charge Q to be transferred during the frame.

Initialization is then performed, with the number of pulses k in that frame being initialized as $k=k_{start}$ (Block 102), with $k_{start}$ being the starting number of pulses caused to be generated by LED driver circuitry 41 for driving the LEDs of the pixel array 14, 14' during the frame. During initialization, a minimum amplitude value $A_{min}$, a maximum amplitude value $A_{max}$, an amplitude increment size $A_{inc}$, a minimum pulse width value $W_{min}$, a maximum pulse width value $W_{max}$, and a pulse width increment size $W_{inc}$ (equal to the period of the clock used to generate the pulse train) are obtained (Block 102), for example from any component of the architecture, such as the interface controller 33, timing controller 34, or blacklight controller 35, or as an alternative may be read from registers within the LED driver circuitry 41, and are based upon the specific application (e.g., desired shape of pulse edges, brightness ranges, etc). Additionally, during initialization, either a fixed starting amplitude $A_{start}$ or a fixed starting width $W_{start}$ is selected, also based upon the specific application.

Thereafter, depending on whether a fixed starting amplitude $A_{start}$ or a fixed starting width $W_{start}$ was used, a width $W_i$ and/or amplitude $A_i$ is evaluated and determined based upon the initialized values (Block 103). The goal for the remainder of the steps performed is to obtain k pulses for the current image frame that each have a same width $W_i$ and a sample amplitude $A_i$. Given the charge Q to be transferred during the frame, each pulse has a same width $W_i$ and a same amplitude $A_i$ this goal is achieved when:

$$Q=k\times A_{pulse}=k\times\tfrac{1}{2}\times A_i(2W_i-t_{rise}-t_{fall})$$

Figure 6B:
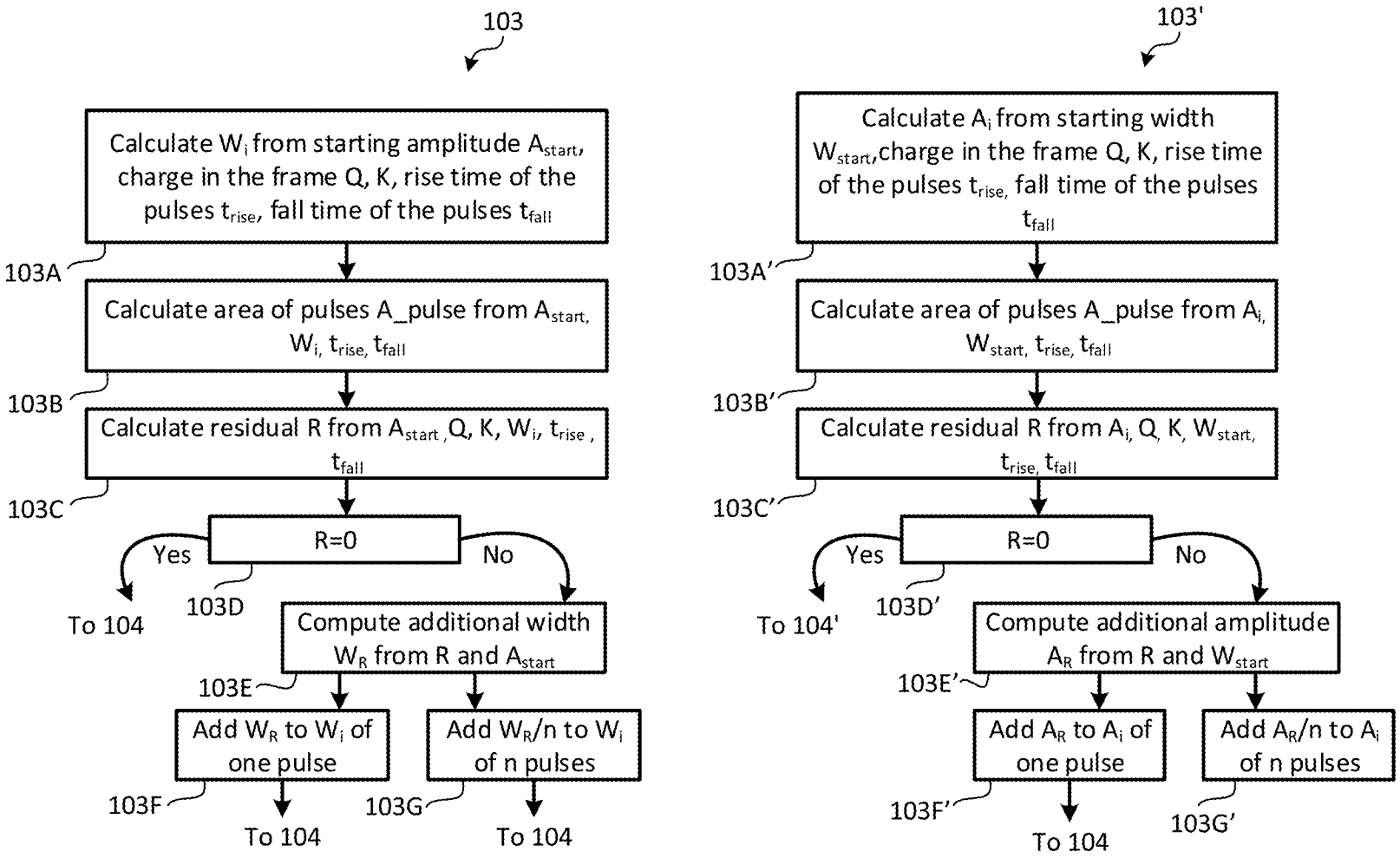
FIG. 6B is a flowchart showing further details of step 103 of the flowchart of FIG. 6A.

Refer now to FIG. 6B for description of the steps of Block 103. First the case where a fixed starting amplitude $A_{start}$ is used is described with reference to flowchart 103 in FIG. 6B.

First, from the starting amplitude $A_{start}$, a width $W_i$ is calculated from the charge Q, the starting number of pulses k, the rise time $t_{rise}$, and the fall time $t_{fall}$ (Block 103A). This calculation is:

$$W_i = \text{round}\left(\frac{Q}{(kA_{start})} + \frac{t_{rise}}{2} + \frac{t_{fall}}{2}\right)$$

The rounding operation is performed to the closest available value of $W_i$, this being the case because the smallest incrementing that can be applied to $W_i$ is by $W_{inc}$, which is set by the clock.

The area of each pulse $A_{pulse}$ may then be calculated from the starting amplitude $A_{start}$, $W_i$, $t_{rise}$, and $t_{fall}$ (Block 103B). This calculation is:

$$A_{pulse} = \frac{A_{start}}{2}(2W_i - t_{rise} - t_{fall})$$

A residual R (e.g., remaining charge to be transferred during the frame if k pulses each having a same amplitude $A_{start}$ and width $W_i$ are present) is then calculated (Block 103C). This calculation is:

$$R = Q - k\times A_{pulse} = Q - k\times\frac{A_{start}}{2}(2W_i - t_{rise} - t_{fall})$$

The resulting value of R is then evaluated (Block 103D). If R is 0, or within a given threshold of 0, this means the goal of transferring the charge Q during the frame with k pulses each having a same width $W_i$ and a same amplitude of $A_i=A_{start}$ is achieved, and operation can proceed to Block 104.

If R is not zero, for example due to a rounding error within $W_i$ arising from the smallest increment $W_{inc}$ for $W_i$, then a correction is to be applied to at least one of the pulses. To this end, an additional pulse width $W_R$ is computed from R and $A_{start}$ (Block 103E). This calculation is performed as:

$$W_R=\text{round}(R/A_{start})$$

This additional width $W_R$ may then be added to the width $W_i$ of one of the k pulses of the frame (Block 103F). This calculation is performed as:

$$W_j=W_i+W_R$$

This may be done to any of the k pulses and not need be a specific pulse. As an alternative, if desired, this additional width $W_R$ may be distributed over n of the k pulses as $W_R/n$ (Block 103G). Operation is then ready to proceed to Block 104.

The case where a fixed starting width $W_{start}$ is used is described with reference to flowchart 103' in FIG. 6B.

First, from the starting width $W_{start}$, an amplitude $A_i$ is calculated from the charge Q, the starting number of pulses k, the rise time $t_{rise}$, and the fall time $t_{fall}$ (Block 103A'). This calculation is:

$$A_i = \text{round}\left(\frac{2Q}{k(2W_{start} - t_{rise} - t_{fall})}\right)$$

The rounding operation is performed to the closest available value of $A_i$, this being the case because the smallest incrementing that can be applied to $A_i$ is by $A_{inc}$, which is defined by the LED driver current resolution.

The area of each pulse $A_{pulse}$ may then be calculated from the amplitude $A_i$, $W_{start}$, $t_{rise}$, and $t_{fall}$ (Block 103B'). This calculation is:

$$A_{pulse} = \frac{A_i}{2}(2W_{start} - t_{rise} - t_{fall})$$

The residual R (e.g., remaining charge to be transferred during the frame if k pulses each having a same amplitude $A_i$ and width $W_{start}$ are present) is then calculated (Block 103C'). This calculation is:

$$R = Q - k\times A_{pulse} = Q - k\times\frac{A_i}{2}(2W_{start} - t_{rise} - t_{fall})$$

The resulting value of R is then evaluated (Block 103D'). If R is 0, or within a given threshold of 0, this means the goal of transferring the charge Q during the frame with k pulses each having a same width $W_i=W_{start}$ and a same amplitude of $A_i$ is achieved, and operation can proceed to Block 104.

If R is not zero, for example due to a rounding error within $A_i$ arising from the smallest increment $A_{inc}$ for $A_i$, then a correction is to be applied to at least one of the pulses. To this end, an additional pulse amplitude $A_R$ is computed from R and $W_{start}$ (Block 103E'). This calculation is performed as:

$$A_R=\text{round}(R/W_{start})$$

This additional amplitude $A_R$ may then be added to the amplitude $A_i$ of one of the k pulses of the frame (Block 103F'). This calculation is performed as:

$$A_j=A_i+A_R$$

This may be done to any of the k pulses and not need be a specific pulse. As an alternative, if desired, this additional amplitude $A_R$ may be distributed over n of the k pulses as $A_R/n$ (Block 103G'). Operation is then ready to proceed to Block 104.

Referring back to FIG. 6A, it is desired for the following constraints to be met:

$$K_{max}\geq 1$$

$$W_{min}\leq W_i\leq W_{max}$$

$$W_{min}\leq W_i\leq W_{max}$$

$$W_{min}\geq t_{rise}+t_{fall}$$

$$A_{min}\leq A_i\leq A_{max}$$

$$A_{min}\leq A_{start}\leq A_{max}$$

Assuming these constraints are met (Blocks 104 and 110), the k pulses each with the same width $W_i$ and the same amplitude $A_i$ are generated so as to cause display of the frame (Block 116), and the process waits for the next image frame (Block 117).

However, these constraints may not be met by the initial values of width $W_i$ and amplitude $A_i$, given certain values of Q.

If the width of the current pulse (ith pulse) is less than the maximum pulse width value (Block 104), e.g., if $W_i<W_{min}$, then the amplitude $A_i$ of the current pulse is evaluated (Block 105).

If the amplitude $A_i$ of the current pulse is not equal to the minimum amplitude $A_{min}$, e.g., if $A_i\neq A_{min}$ (Block 105), then the amplitude $A_i$ of the current pulse is decremented by the amplitude increment size $A_{inc}$, e.g., $A_i=A_i-A_{inc}$ (Block 108), and a return is made to Block 103. At Block 103, $W_i$ is recalculated such that each of the k pulses in the frame have a same width $W_i$ and a same amplitude $A_i$ (with $A_i$ having been update at Block 108) such that the area of the pulse train is equal to Q.

Returning back to the discussion of Block 105, if the amplitude $A_i$ of the current pulse is equal to the minimum amplitude $A_{min}$, e.g., if $A_i=A_{min}$ (Block 105), then the current value of k is evaluated (Block 106). If the number of pulses k in the current frame is not equal to one, e.g., if $k\neq 1$, then k is decremented by one, e.g., $k=k-1$ (Block 107), and the process returns to Block 103. At Block 103, $W_i$ is recalculated such that each of the k pulses (with k having been decremented at Block 107) in the frame have a same width $W_i$ and a same amplitude $A_i$ such that the area of the pulse train is equal to Q.

Returning back to the discussion of Block 106, if the number of pulses k in the current frame is equal to one, e.g., if k=1, then no pulses are generated by the LED driver circuitry 41 (Block 109), in which case illumination for this image frame will not be produced, and the process then waits for the next image frame (Block 117).

If, at evaluation of the width $W_i$ of the current (ith) pulse (Block 103), the width $W_i$ of the current pulse is not less than the minimum pulse width value (Block 104), e.g., if $W_i\geq W_{min}$, then the width $W_i$ of the current pulse is compared to the maximum pulse width $W_{max}$ (Block 110). If the width $W_i$ of the current pulse is not greater than the maximum pulse width $W_{max}$, e.g., if $W_i\leq W_{max}$, then as explained above the remaining pulses are generated by the LED driver circuitry 41 without further modification (Block 116), and the process waits for the next image frame (Block 117).

If the width $W_i$ of the current pulse is greater than the maximum pulse width $W_{max}$, e.g., if $W_i>W_{max}$ (Block 110), then the amplitude $A_i$ of the current pulse is evaluated (Block 111). If the amplitude $A_i$ of the current pulse is not equal to the maximum amplitude $A_{max}$, e.g., if $A_i\neq A_{max}$, then the amplitude $A_i$ of the current pulse is incremented by the amplitude increment size $A_{inc}$, e.g., $A_i=A_i+A_{inc}$ (Block 112), and the process returns to Block 103. If the amplitude $A_i$ of the current pulse is equal to the maximum amplitude $A_{max}$, e.g., if $A_i=A_{max}$, then the current value of k is evaluated (Block 113). If the current value of k is not equal to $k_{start}$, i.e., $k\neq k_{start}$, then k is incremented by one, i.e., $k=k+1$ (Block 114), and the process returns to Block 103. If the current value of k is equal to starting maximum number of pulses that may be present in a single frame $k_{start}$, i.e., $k=k_{start}$, then all pulses with a width $W_i$ greater than the maximum width $W_{max}$, i.e., $W_i>W_{max}$, are set to the maximum width $W_{max}$ (Block 115), the remaining pulses are generated by the LED driver circuitry 41 to thereby achieve maximum brightness for the given LEDs within the system (Block 116), and the process waits for the next image frame (Block 117).

The above-described technique for generation of the current pulses that drive the LEDs of the pixel array 14, 14' during the frame are effective in producing the desired degree of brightness without causing visible flicker. Also, the probability of a pulse being skipped is reduced, and the probability of low frequency components being displayed.

Figure 7:
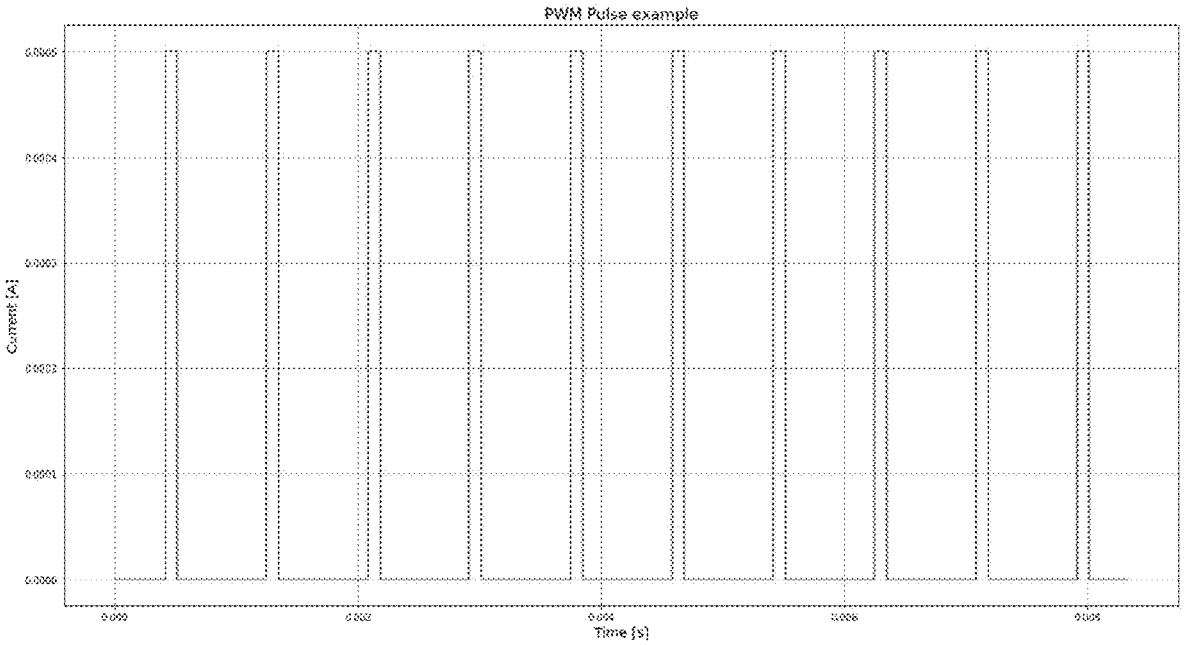
FIG. 7 includes a graph showing an example of one train of pulses used to drive the LEDs of FIG. 3 or 4 when performing the technique of FIG. 6, and a graph showing the frequency spectrum of the light produced by the LEDs when performing the technique of FIG. 6.
Figure 7:
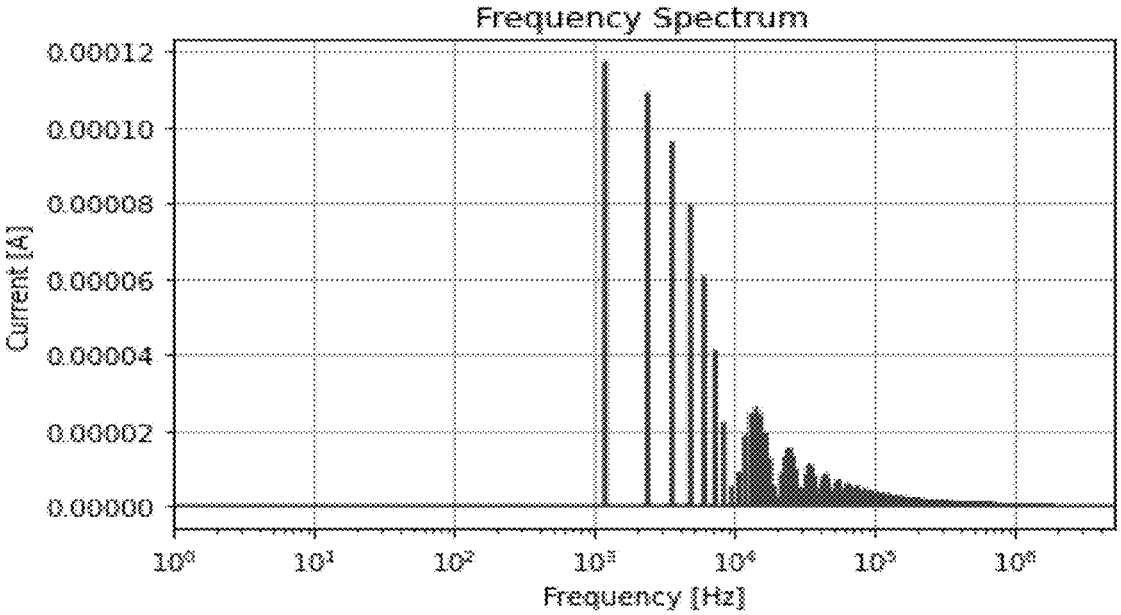

A graph showing sample current pulses and the frequency spectrum of produced light generated using the techniques described above is found in FIG. 7. In this example, Q=500 mA/μs, $K_{start}=10$, $W_{min}=2$ μs, $W_{max}=500$ μs, $W_{inc}=100$ ns, $A_{min}=300$ μA, $A_{max}=20$ mA, $A_{inc}=600$ nA, $A_{start}=500$ μA, $t_{rise}=t_{fall}=500$ ns, and the frame rate is 120 Hz. As can be observed, the results yield 10 pulses in the current frame, each having a 100.5 μs duration and a 500 μA amplitude. The minimum harmonic frequency is 1.2 kHz, thereby avoiding flicker because there are no harmonic components below 600 Hz.

It is clear that modifications and variations may be made to what has been described and illustrated herein, without thereby departing from the scope of this disclosure, as defined in the annexed claims.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. A method of driving a light emitting diode (LED) array, comprising:

a) receiving image data for a new image frame;

b) determining a total aggregate charge to be transferred to LEDs of the LED array during the image frame;

c) determining a number of drive pulses of equal width and equal amplitude that would drive the LEDs with the total aggregate charge during display of the image frame, and if it is not possible given operating conditions for each pulse to have an equal width and an equal amplitude while driving the LEDs with the total aggregate charge during the display of the image frame, determining a number of drive pulses of equal width and equal amplitude that would drive the LEDs with nearly the total aggregate charge during the display of the image frame and modifying at least one of the number of drive pulses based upon residual charge to be transferred during the display of the image frame such that the number of drive pulses can drive the LEDs with the total aggregate charge during the display of the image frame;

d) if the width of the number of drive pulses is greater than a minimum width and less than a maximum width, driving the LEDs with the number of drive pulses; and e) if the width of the number of drive pulses is less than the minimum width:

i. if an amplitude of the number of drive pulses is greater than a minimum amplitude, decrementing the amplitude of the number of drive pulses and returning to c) to recalculate the width of the number of drive pulses such that each drive pulse has the decremented amplitude and the recalculated width;

ii. if the amplitude of the number of drive pulses is equal to the minimum amplitude, and if the number of drive pulses is greater than one, decrementing the number of the drive pulses and returning to c) to recalculate the decremented number of the drive pulses as having an equal width and equal amplitude that would drive the LEDs with the total aggregate charge during display of the image frame; and iii. if the amplitude of the number of drive pulses is equal to the minimum amplitude, and if the number of drive pulses is equal to one, not driving the LEDs with the number of drive pulses and then returning to step a).

2. The method of claim 1, wherein the modifying of at least one of the number of drive pulses comprises modifying the amplitude of at least one of the number of drive pulses based upon the residual charge to be transferred during the display of the image frame.

3. The method of claim 1, wherein the modifying of at least one of the number of drive pulses comprises modifying the width of at least one of the number of drive pulses based upon the residual charge to be transferred during the display of the image frame.

4. The method of claim 1, wherein determining the number of drive pulses of equal width and equal amplitude comprises:

setting the amplitude of the number of drive pulses to be equal to a fixed starting amplitude;

determining the width of the number of drive pulses based upon the fixed starting amplitude, the total aggregate charge, the number of drive pulses, a rise time of the number of drive pulses, and a fall time of the number of drive pulses;

determining the residual charge to be transferred; and if the residual charge is not within a threshold of zero, modifying the width of at least one of the number of drive pulses based upon the residual charge and the fixed starting amplitude.

5. The method of claim 1, wherein determining the number of drive pulses of equal width and equal amplitude comprises:

setting the width of the number of drive pulses to be equal to a fixed starting width;

determining the amplitude of the number of drive pulses based upon the fixed starting width, the total aggregate charge, the number of drive pulses, a rise time of the number of drive pulses, and a fall time of the number of drive pulses;

determining the residual charge to be transferred; and if the residual charge is not within a threshold of zero, modifying the amplitude of at least one of the number of drive pulses based upon the residual charge and the fixed starting width.

6. The method of claim 1, further comprising:

f) if the width of the number of drive pulses is not less than the minimum width and the width of the number of drive pulses is greater than the maximum width:

i. if the amplitude of the number of drive pulses is less than a maximum amplitude, incrementing the amplitude of the number of drive pulses and returning to c) to recalculate the width of the number of drive pulses such that each drive pulse has the incremented amplitude and the recalculated width;

ii. if the amplitude of the number of drive pulses is less than the maximum amplitude and the number of drive pulses is equal to an initial number of drive pulses, setting the width of the number of drive pulses to the maximum width and driving the LEDs with the number of drive pulses; and iii. if the amplitude of the number of drive pulses is less than the maximum amplitude and the number of drive pulses is less than the initial number of drive pulses, incrementing the number of the drive pulses and returning to c) to recalculate the incremented number of the drive pulses as having an equal width and equal amplitude that would drive the LEDs with the total aggregate charge during display of the image frame.

7. A display panel, comprising:

an array of light emitting diodes (LEDs);

drive circuitry for the array of LEDs;

control circuitry configured to cause the drive circuitry to drive the array of LEDs by:

receiving image data for a new image frame to be displayed by at least the array of LEDs;

determining a total aggregate charge to be transferred to LEDs of the array of LEDs;

determining a number of drive pulses of equal width and equal amplitude that would drive the LEDs with the total aggregate charge during display of the image frame, and if it is not possible given operating conditions for each pulse to have an equal width and an equal amplitude while driving the LEDs with the total aggregate charge during the display of the image frame, determining a number of drive pulses of equal width and equal amplitude that would drive the LEDs with nearly the total aggregate charge during the display of the image frame and modifying at least one of the number of drive pulses based upon residual charge to be transferred during the display of the image frame such that the number of drive pulses can drive the LEDs with the total aggregate charge during the display of the image frame;

if the width of the number of drive pulses is greater than a minimum width and less than a maximum width, driving the LEDs with the number of drive pulses; and if the width of the number of drive pulses is less than the minimum width:

if an amplitude of the number of drive pulses is greater than a minimum amplitude, decrementing the amplitude of the number of drive pulses and recalculating the width of the number of drive pulses such that each drive pulse has the decremented amplitude and the recalculated width;

if the amplitude of the number of drive pulses is equal to the minimum amplitude, and if the number of drive pulses is greater than one, decrementing the number of the drive pulses and recalculating the decremented number of the drive pulses as having an equal width and equal amplitude that would drive the LEDs with the total aggregate charge during display of the image frame; and if the amplitude of the number of drive pulses is equal to the minimum amplitude, and if the number of drive pulses is equal to one, not driving the LEDs with the number of drive pulses.

8. The display panel of claim 7, wherein the control circuitry modifies at least one of the number of drive pulses by modifying the amplitude of at least one of the number of drive pulses based upon the residual charge to be transferred during the display of the image frame.

9. The display panel of claim 7, wherein the control circuitry modifies at least one of the number of drive pulses by modifying the width of at least one of the number of drive pulses based upon the residual charge to be transferred during the display of the image frame.

10. The display panel of claim 7, wherein the control circuitry determines the number of drive pulses of equal width and equal amplitude by:

setting the amplitude of the number of drive pulses to be equal to a fixed starting amplitude;

determining the width of the number of drive pulses based upon the fixed starting amplitude, the total aggregate charge, the number of drive pulses, a rise time of the number of drive pulses, and a fall time of the number of drive pulses;

determining the residual charge to be transferred; and if the residual charge is not within a threshold of zero, modifying the width of at least one of the number of drive pulses based upon the residual charge and the fixed starting amplitude.

11. The display panel of claim 7, wherein the control circuitry determines the number of drive pulses of equal width and equal amplitude by:

setting the width of the number of drive pulses to be equal to a fixed starting width;

determining the amplitude of the number of drive pulses based upon the fixed starting width, the total aggregate charge, the number of drive pulses, a rise time of the number of drive pulses, and a fall time of the number of drive pulses;

determining the residual charge to be transferred; and if the residual charge is not within a threshold of zero, modifying the amplitude of at least one of the number of drive pulses based upon the residual charge and the fixed starting width.

12. The display panel of claim 7, wherein the control circuitry is further configured to cause the drive circuitry to drive the array of LEDs by:

if the width of the number of drive pulses is not less than the minimum width and the width of the number of drive pulses is greater than the maximum width:

if the amplitude of the number of drive pulses is less than a maximum amplitude, incrementing the amplitude of the number of drive pulses and recalculating the width of the number of drive pulses such that each drive pulse has the incremented amplitude and the recalculated width;

if the amplitude of the number of drive pulses is less than the maximum amplitude and the number of drive pulses is equal to an initial number of drive pulses, setting the width of the number of drive pulses to the maximum width and driving the LEDs with the number of drive pulses; and if the amplitude of the number of drive pulses is less than the maximum amplitude and the number of drive pulses is less than the initial number of drive pulses, incrementing the number of the drive pulses and recalculating the incremented number of the drive pulses as having an equal width and equal amplitude that would drive the LEDs with the total aggregate charge during display of the image frame.

13. A method of driving a light emitting diode (LED) array, comprising:

a) receiving image data for a new image frame;

b) determining a total aggregate charge to be transferred to LEDs of the LED array during the image frame;

c) determining a number of drive pulses of equal width and equal amplitude that would drive the LEDs with nearly the total aggregate charge during display of the image frame;

d) determining a residual charge to be transferred during the display of the image frame based upon the total aggregate charge to be transferred during the display of the image frame and based upon an aggregate charge that would be transferred by the drive pulses;

e) if the residual charge to be transferred during the display of the image frame is not within a threshold of zero, modifying at least one of the number of drive pulses based upon the residual charge to be transferred during the display of the image frame such that the drive pulses can drive the LEDs with the total aggregate charge during the display of the image frame;

f) if the width of the number of drive pulses is greater than a minimum width and less than a maximum width, driving the LEDs with the number of drive pulses; and g) if the width of the number of drive pulses is not less than the minimum width and the width of the number of drive pulses is greater than the maximum width:

i. if the amplitude of the number of drive pulses is less than a maximum amplitude, incrementing the amplitude of the number of drive pulses and returning to c) to recalculate the width of the number of drive pulses such that each drive pulse has the incremented amplitude and the recalculated width;

ii. if the amplitude of the number of drive pulses is less than the maximum amplitude and the number of drive pulses is equal to an initial number of drive pulses, setting the width of the number of drive pulses to the maximum width and driving the LEDs with the number of drive pulses; and iii. if the amplitude of the number of drive pulses is less than the maximum amplitude and the number of drive pulses is less than the initial number of drive pulses, incrementing the number of the drive pulses and returning to c) to recalculate the incremented number of the drive pulses as having an equal width and equal amplitude that would drive the LEDs with the total aggregate charge during display of the image frame.

14. The method of claim 13, further comprising:

h) if the width of the number of drive pulses is less than the minimum width:

i. if an amplitude of the number of drive pulses is greater than a minimum amplitude, decrementing the amplitude of the number of drive pulses and returning to c) to recalculate the width of the number of drive pulses such that each drive pulse has the decremented amplitude and the recalculated width;

ii. if the amplitude of the number of drive pulses is equal to the minimum amplitude, and if the number of drive pulses is greater than one, decrementing the number of the drive pulses and returning to c) to recalculate the decremented number of the drive pulses as having an equal width and equal amplitude that would drive the LEDs with the total aggregate charge during display of the image frame; and iii. if the amplitude of the number of drive pulses is equal to the minimum amplitude, and if the number of drive pulses is equal to one, not driving the LEDs with the number of drive pulses and then returning to step a).

15. The method of claim 13, wherein determining the number of drive pulses of equal width and equal amplitude comprises:

setting the amplitude of the number of drive pulses to be equal to a fixed starting amplitude;

determining the width of the number of drive pulses based upon the fixed starting amplitude, the total aggregate charge, the number of drive pulses, a rise time of the number of drive pulses, and a fall time of the number of drive pulses.

16. The method of claim 15, wherein, if the residual charge is not within a threshold of zero, modifying the width of at least one of the number of drive pulses based upon the residual charge to be transferred during the display of the image frame such that the drive pulses can drive the LEDs with the total aggregate charge during the display of the image frame comprises modifying the width of at least one of the number of drive pulses based upon the residual charge and the fixed starting amplitude.

17. The method of claim 13, wherein determining the number of drive pulses of equal width and equal amplitude comprises:

setting the width of the number of drive pulses to be equal to a fixed starting width; and determining the amplitude of the number of drive pulses based upon the fixed starting width, the total aggregate charge, the number of drive pulses, a rise time of the number of drive pulses, and a fall time of the number of drive pulses.

18. The method of claim 17, wherein, if the residual charge is not within a threshold of zero, modifying the width of at least one of the number of drive pulses based upon the residual charge to be transferred during the display of the image frame such that the drive pulses can drive the LEDs with the total aggregate charge during the display of the image frame comprises modifying the width of at least one of the number of drive pulses based upon the residual charge and the fixed starting width.

* * * * *